US010668717B2

(12) United States Patent
Azuma et al.

(10) Patent No.: US 10,668,717 B2
(45) Date of Patent: Jun. 2, 2020

(54) LIQUID EJECTION APPARATUS, CORRECTION METHOD, AND STORAGE MEDIUM

(71) Applicant: CANON KABUSHIKI KAISHA, Tokyo (JP)

(72) Inventors: Satoshi Azuma, Tokyo (JP); Kazuhiko Sato, Tokyo (JP); Kazuo Suzuki, Yokohama (JP); Yoshinori Nakajima, Yokohama (JP); Masataka Kato, Yokohama (JP); Mitsutoshi Nagamura, Tokyo (JP); Shin Genta, Yokohama (JP); Shingo Nishioka, Yokohama (JP); Sae Tabuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/210,516

(22) Filed: Dec. 5, 2018

(65) Prior Publication Data

US 2019/0176467 A1 Jun. 13, 2019

(30) Foreign Application Priority Data

Dec. 13, 2017 (JP) ..... 2017-238891

(51) Int. Cl.
*B41J 2/045* (2006.01)

(52) U.S. Cl.
CPC ..... *B41J 2/04508* (2013.01); *B41J 2/0454* (2013.01); *B41J 2/0458* (2013.01); (Continued)

(58) Field of Classification Search
CPC .. B41J 2/04508; B41J 2/04568; B41J 2/0454; B41J 2/04553; B41J 2/0458; B41J 2/04581
See application file for complete search history.

(56) References Cited

U.S. PATENT DOCUMENTS 5,646,655 A 7/1997 Iwasaki et al.
6,719,395 B2 4/2004 Iwasaki et al.
(Continued)

FOREIGN PATENT DOCUMENTS

JP 07-60994 A 3/1995
JP H07-060994 A 3/1995
JP 2016-159619 A 9/2016

OTHER PUBLICATIONS

Jan. 28, 2020 Japanese Official Action in Japanese Patent Appln. No. 2017-238891.

*Primary Examiner* — Sharon A. Polk
(74) *Attorney, Agent, or Firm* — Venable LLP

(57) ABSTRACT

An object of the present invention is to quickly correct a temperature sensor for an ejection head by, both efficiently and in a brief time, estimating a detected temperature of the temperature sensor for the ejection head in a case where the temperature of the ejection head of liquid becomes sufficiently close to an environment temperature. The temperature of a print head 1 is detected by a diode sensor 17 and the environment temperature is detected by a thermistor 10. Based on a change in the detected temperature of the diode sensor 17 at the time of filling of ink for the print head 1, the detected temperature of the diode sensor 17 in a case where the temperature of the print head 1 becomes close to the environment temperature is estimated as an estimated detected temperature. Based on a difference between the estimated detected temperature and the environment temperature, a correction value of the detected temperature of the diode sensor 17 is set.

12 Claims, 12 Drawing Sheets

(52) U.S. Cl.
CPC ..... *B41J 2/04553* (2013.01); *B41J 2/04563* (2013.01); *B41J 2/04581* (2013.01)

(56) References Cited

U.S. PATENT DOCUMENTS

| | | | | |
|---|---|---|---|---|
| 8,950,843 | B2 | 2/2015 | Oikawa et al. | |
| 9,415,588 | B1 | 8/2016 | Azuma et al. | |
| 9,862,187 | B1 * | 1/2018 | Mu | B41J 2/0454 |
| 2002/0041300 | A1 | 4/2002 | Iwasaki et al. | |
| 2011/0221820 | A1 * | 9/2011 | Shibata | B41J 2/04563 347/17 |
| 2016/0257115 | A1 | 9/2016 | Azuma et al. | |

* cited by examiner

FIG.6A EXPRESSION 1 $$\frac{dQ}{dt} = -\alpha S(T - Tm)$$

FIG.6B EXPRESSION 2 $$Q = mcT$$

FIG.6C EXPRESSION 3 $$\frac{dT}{dt} = -\beta(T - Tm)$$

FIG.6D EXPRESSION 4 $$\beta = \frac{\alpha s}{mc}$$

FIG.6E EXPRESSION 5 $$T = (T0 - Tm)\exp(-\beta t) + Tm$$

FIG.6F EXPRESSION 6 $$A = \frac{1}{1 - \exp(\beta \Delta t)}$$

$$B = \frac{1}{1 - \exp(-\beta \Delta t)}$$

※$A + B = 1$

FIG.6G EXPRESSION 7 $$Tm = AT1 + BT2$$

FIG.6H EXPRESSION 8 $$Te = T2 + A \cdot \Delta T$$

FIG.6I EXPRESSION 9 $$Tm = \frac{\sum_{i=1}^{N} Tm(i)}{N} = \frac{\sum_{i=1}^{N} (ATi + BTi + 1)}{N}$$

| Symbol | Item | | Remarks | Calculation expression | Kind of fluid | |
|---|---|---|---|---|---|---|
| | | | | | air | ink |
| $\beta$ | proportion constant | | - | | 0.0018 | 0.018 |
| A | constant A | | - | $A = 1 / (1 - \exp(\beta \Delta t))$ | -8.77 | -0.51 |
| B | constant B | | - | $B = 1 / (1 - \exp(-\beta \Delta t))$ | 9.77 | 1.51 |
| Tm | environment temperature[℃] | | - | | 25 | 25 |
| $\Delta t$ | read interval of head temperature (ink filling time)[sec] | | - | | 60 | 60 |
| T1 | head temperature before ink filling[℃] | | true value | | 40.0 | 40.0 |
| T2 | head temperature after ink filling[℃] | | true value | | 38.5 | 30.1 |
| $\Delta T$ | head temperature difference before and after ink filling[℃] | | true value | $\Delta T = T1 - T2$ | 1.5 | 9.9 |
| Ead | read error of head temperature | A/D conversion error[℃] | accidental error | | ±0 | ±0 |
| Eofs | | offset error[℃] | systematic error | | 3.0 | 3.0 |
| T1′ | head temperature before ink filling[℃] | | value including error | $T1' = T1 + Eofs + Ead$ | 43.0 | 43.0 |
| T2′ | head temperature after ink filling[℃] | | value including error | $T2' = T2 + Eofs + Ead$ | 41.5 | 33.1 |
| $\Delta T'$ | head temperature difference before and after ink filling[℃] | | value including error | $\Delta T' = T1' - T2' = T1 - T2 + 2 * Ead$ | 1.5 | 9.9 |
| Te′ | estimated value of head temperature after having become sufficiently familiar therewith[℃] | | value including error | $Te' = T2' + A * \Delta T'$ | 28.0 | 28.0 |
| Tadj | Di correction value of head[℃] | | - | $Tadj = Tm - Te'$ | -3.0 | -3.0 |

FIG.9A

| Symbol | Item | | Remarks | Calculation expression | Kind of fluid | |
|---|---|---|---|---|---|---|
| | | | | | air | ink |
| $\beta$ | proportion constant | | - | | 0.0018 | 0.018 |
| A | constant A | | - | $A = 1 / (1 - \exp(\beta \Delta t))$ | -8.77 | -0.51 |
| B | constant B | | - | $B = 1 / (1 - \exp(-\beta \Delta t))$ | 9.77 | 1.51 |
| Tm | environment temperature[℃] | | - | | 25 | 25 |
| $\Delta t$ | read interval of head temperature (ink filling time)[sec] | | - | | 60 | 60 |
| T1 | head temperature before ink filling[℃] | | true value | | 40.0 | 40.0 |
| T2 | head temperature after ink filling[℃] | | true value | | 38.5 | 30.1 |
| $\Delta T$ | head temperature difference before and after ink filling[℃] | | true value | $\Delta T = T1 - T2$ | 1.5 | 9.9 |
| Ead | read error of head temperature | A/D conversion error[℃] | accidental error | | ±0.15 | ±0.15 |
| Eofs | | offset error[℃] | systematic error | | 3.0 | 3.0 |
| T1′ | head temperature before ink filling[℃] | | value including error | $T1' = T1 + Eofs + Ead$ | 43.2 | 43.2 |
| T2′ | head temperature after ink filling[℃] | | value including error | $T2' = T2 + Eofs + Ead$ | 41.3 | 32.9 |
| $\Delta T'$ | head temperature difference before and after ink filling[℃] | | value including error | $\Delta T' = T1' - T2' = T1 - T2 + 2 * Ead$ | 1.8 | 10.2 |
| Te′ | estimated value of head temperature after having become sufficiently familiar therewith[℃] | | value including error | $Te' = T2' + A * \Delta T'$ | 25.2 | 27.7 |
| Tadj | Di correction value of head[℃] | | - | $Tadj = Tm - Te'$ | -0.2 | -2.7 |

FIG.9B

LIQUID EJECTION APPARATUS, CORRECTION METHOD, AND STORAGE MEDIUM

BACKGROUND OF THE INVENTION

Field of the Invention

The present invention relates to a liquid ejection apparatus capable of ejecting various liquids, an ink jet printing apparatus, a correction method, and a storage medium.

Description of the Related Art

In a case where a print head is controlled in accordance with the temperature of the print head as a liquid ejection head in an ink jet printing apparatus as a liquid ejection apparatus, as a temperature sensor for the print head, a diode sensor or the like that can be formed on a substrate of the print head is used frequently. The diode sensor has a large offset tolerance, and therefore, in general, the detected temperature of the diode sensor is corrected with an environment temperature detected by the temperature sensor, such as a thermistor, as a reference. In a case where a correction value thereof is found, it is premised that the temperature of the print head and the environment temperature are substantially the same. However, for example, in a case where a print head immediately after being brought out from the inside of a car under a blazing sun or from a storage in the cold state is attached to a printing apparatus in the normal temperature state, the temperature of the print head is largely different from the environment temperature, and therefore, it is not possible to find a correction value quickly.

Japanese Patent Laid-Open No. H7-60994 (1995) has described a method of finding a correction value based on a detected temperature by acquiring the detected temperature of the print head in a constant state twice or more times and by estimating in advance the detected temperature of the temperature sensor for the print head in a case where the temperature of the print head becomes sufficiently close to the environment temperature. Further, Japanese Patent Laid-Open No. 2016-159619 has described a method of setting a fixed value set in advance as a correction value by determining that the temperature of the print head has not become sufficiently close to the environment temperature in a case where the temperature difference of the print head between before and after ink filling for the print head is larger than a predetermined threshold value.

SUMMARY OF THE INVENTION

In the method of Japanese Patent Laid-Open No. H7-60994 (1995), in a case where the time interval of the two-time temperature detection of the print head is reduced in order to quickly find a correction value of the temperature sensor, the estimation accuracy is lowered and on the other hand, in a case where the time interval thereof is lengthened, it takes a long time until the printing apparatus becomes capable of performing printing. Further, in the method of Japanese Patent Laid-Open No. 2016-159619, in a case where the fixed value set in advance is taken to be the correction value, the offset tolerance unique to the temperature sensor for the print head is left uncorrected.

An object of the present invention is to quickly correct the temperature sensor for an ejection head by, both efficiently and in a brief time, estimating the detected temperature of the temperature sensor for the ejection head in a case where the temperature of the liquid ejection head becomes sufficiently close to the environment temperature.

The liquid ejection apparatus of the present invention includes: an ejection head capable of ejecting a liquid; a first detection unit configured to detect a temperature of the ejection head; a second detection unit configured to detect an environment temperature of the ejection head; a filling unit configured to fill the ejection head with the liquid; an estimation unit configured to estimate a detected temperature of the first detection unit in a case where the temperature of the ejection head becomes close to the environment temperature as an estimated detected temperature based on a temperature change in the detected temperature of the first detection unit at the time of filling of the liquid by the filling unit; a setting unit configured to set a correction value of the first detection unit based on a difference between the estimated detected temperature and the environment temperature; a correction unit configured to correct the first detection unit based on the correction value; and a control unit configured to control the ejection head based on the detected temperature of the first detection unit corrected by the correction unit.

Further features of the present invention will become apparent from the following description of exemplary embodiments with reference to the attached drawings.

BRIEF DESCRIPTION OF THE DRAWINGS

FIG. 6A to FIG. 6I are explanatory diagrams of expressions relating to heat exchange between a solid and a fluid;

FIG. 9A and FIG. 9B are explanatory diagrams of specific numerical values in a calculation process of a correction value of the detected temperature of the diode sensor;

DESCRIPTION OF THE EMBODIMENTS

In the following, embodiments of the present invention are explained based on the drawings.

First Embodiment

FIG. 1 to FIG. 9B are diagrams for explaining a first embodiment of the present invention.

[Outline Configuration of Printing Apparatus]

Figure 1:
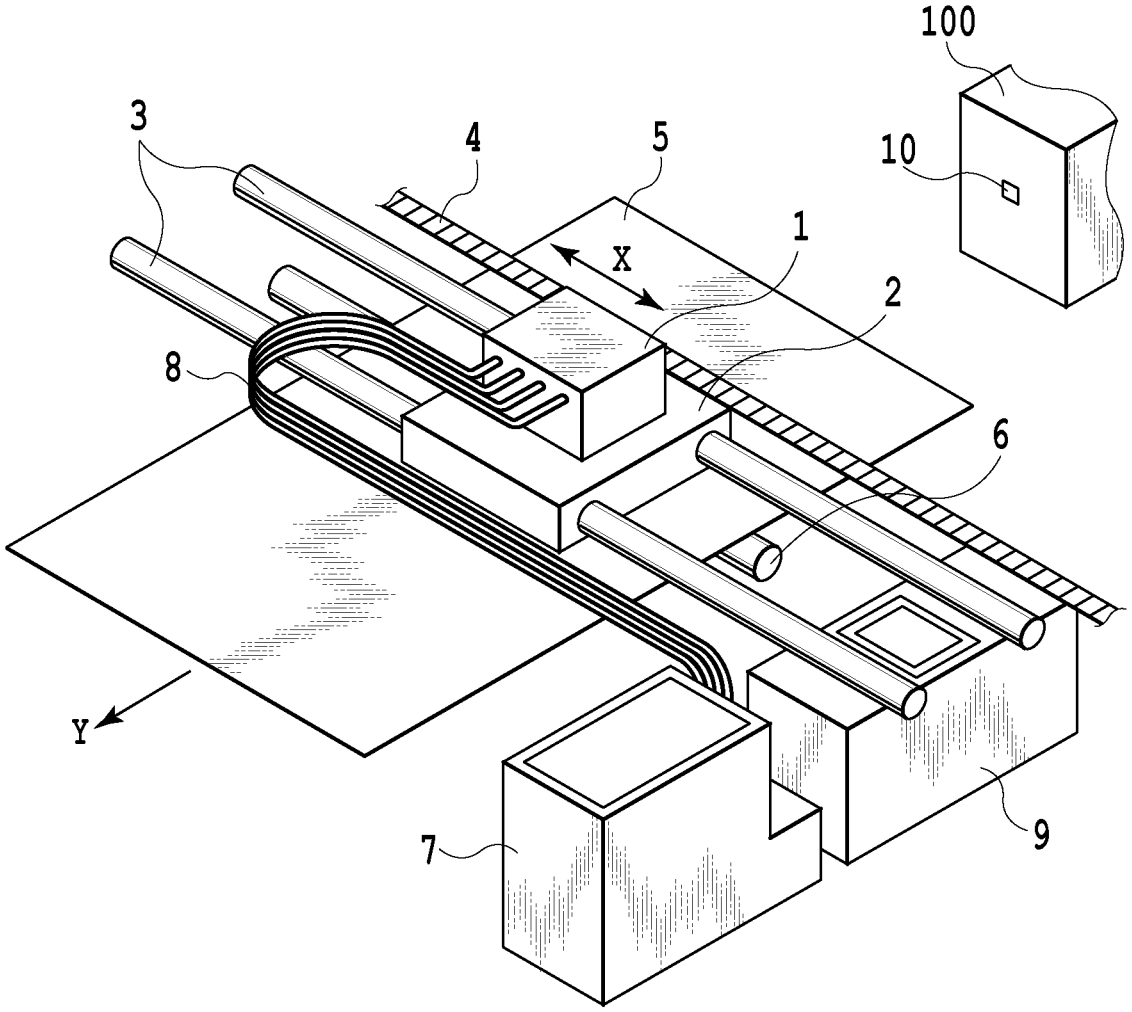
FIG. 1 is a schematic perspective diagram of an ink jet printing apparatus in a first embodiment of the present invention.

FIG. 1 is a schematic perspective diagram of an ink jet printing apparatus in the first embodiment of the present invention. The ink jet printing apparatus of the present embodiment is a so-called serial printing apparatus that prints an image accompanied by a reciprocating motion of a print head 1 in the print width direction of a printing medium 5.

The print head 1 is an ink jet print head capable of ejecting ink from a plurality of ejection ports and is mounted on a carriage 2 in an attachable and detachable manner. The carriage 2 reciprocates in the main scanning direction of an arrow X. Specifically, the carriage 2 is movably supported along a guide rail 3 extending in the main scanning direction and is linked to an endless belt 4 that moves in parallel to the guide rail 3. By the endless belt 4 being reciprocated by a drive force of a carriage motor (CR motor), the print head 1 reciprocates in the main scanning direction together with the carriage 2. The printing medium 5 is conveyed in the sub scanning direction of an arrow Y intersecting (in the case of the present embodiment, perpendicular to) the main scanning direction by a conveyance roller 6. An ink supply system 7, to be described in detail, includes a plurality of independent main tanks corresponding to each ink color. The ink supply system 7 and the print head 1 are connected by a plurality of flexible supply tubes 8 corresponding to ink colors. It is possible to independently supply each color ink stored within the main tank to each nozzle column of the print head 1 corresponding thereto.

The serial printing apparatus such as this prints an image on the printing medium 5 by repeating the print scan of moving the carriage 2 together with the print head 1 in the main scanning direction while ejecting ink from the print head 1 and the conveyance operation of the printing medium 5 in the sub scanning direction. Further, the main body of the printing apparatus includes a recovery processing device 9 for maintaining a favorable ink ejection state of the print head 1. The recovery processing device 9 includes a capping mechanism capable of covering the ejection port of the print head 1 by a cap and a pump mechanism capable of sucking in ink via the cap from the ejection port of the print head 1. Further, in the vicinity of a main control unit 100 of the printing apparatus including a CPU (see FIG. 3) 101 and the like, a thermistor (second temperature sensor) 10 for detecting an ambient temperature (environment temperature) within the printing apparatus is included.

[Print Head]

Figure 2A:
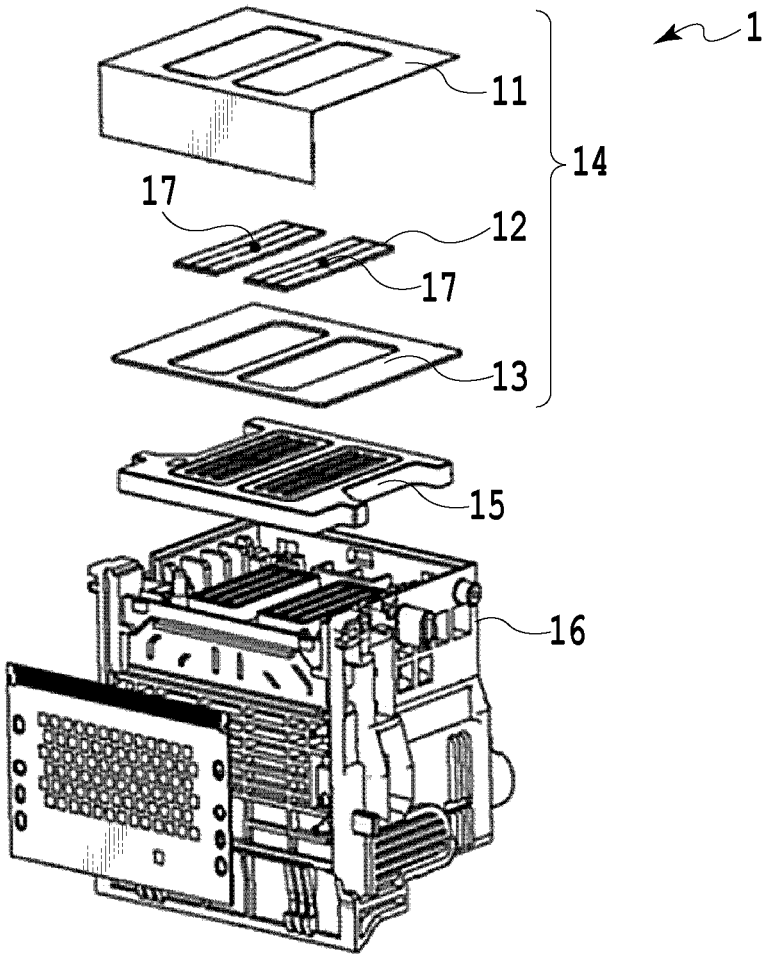
FIG. 2A and FIG. 2B are each a perspective diagram of a print head in FIG. 1.
Figure 2B:
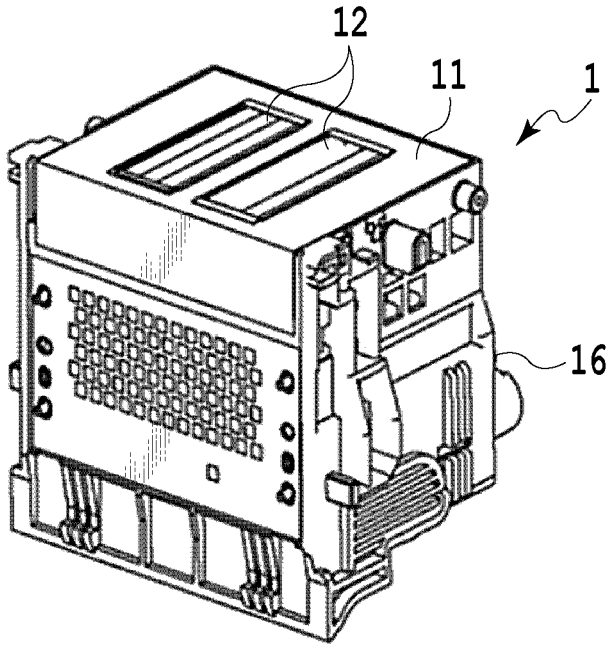

FIG. 2A is an exploded perspective diagram of the print head 1 and FIG. 2B is a perspective diagram of the print head 1 after assembly.

As shown in FIG. 2A, the print head 1 has a form in which a print element unit 14, a chip plate 15, and a support member 16 are joined. The print element unit 14 includes an electric wire sheet 11, a print element substrate 12 including a print element, and a deformation prevention member 13 that prevents deformation of the electric wire sheet 11. The print element of the present embodiment is configured to eject ink within a pressure chamber from an ejection port by using an ejection energy generation element that generates energy to eject ink. As the ejection energy generation element, it is possible to use an electric heat conversion element (heater), a piezoelectric element and so on. The electric wire sheet 11 is manufactured by a TAB (Tape-Automated Bonding) method. On the print element substrate 12, a diode sensor (second detection unit) 17 for detecting the temperature in the vicinity of the print element is arranged. The deformation prevention member 13 is formed mainly by alumina or the like and the support member 16 is formed mainly by denatured PPE (polyphenylene ether) or the like. The chip plate 15 is assembled so as to enter the inside of the support member 16, and therefore, the assembly properties thereof are excellent. Further, in order to seal a gap between the deformation prevention member 13 and the support member 16, a sealing material, such as a resin product, is used.

[Detection Circuit of Temperature of Print Head]

Figure 3:
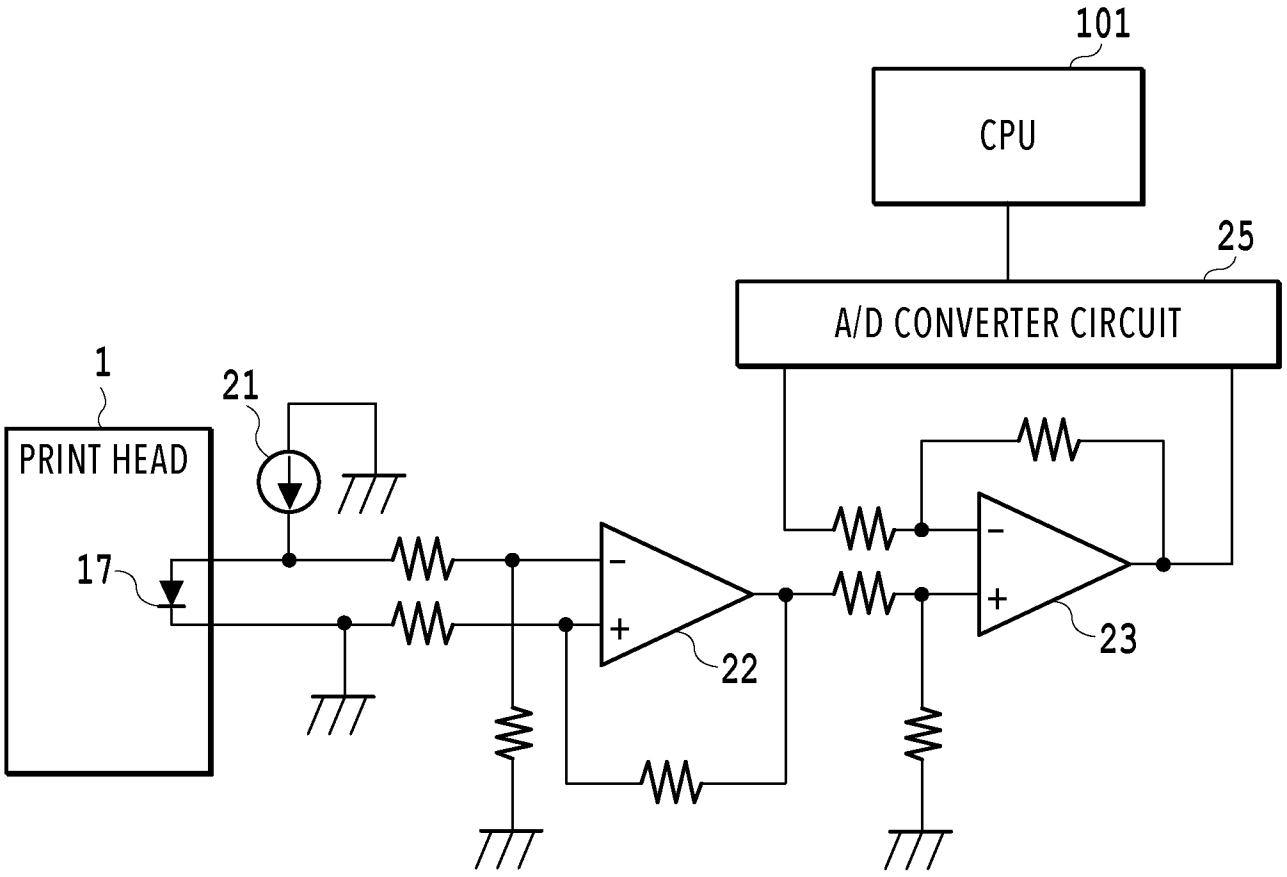
FIG. 3 is an explanatory diagram of a detection circuit of the temperature of the print head in FIG. 2A and FIG. 2B.

FIG. 3 is an explanatory diagram of a detection circuit of the temperature of the print head 1. In the circuit of the present embodiment, by a constant current circuit 21 provided outside the print head 1, a bias current is supplied to the diode sensor 17 within the print head 1 and a forward voltage of the diode sensor 17 is amplified by amplifier circuits 22 and 23. The output voltage of the amplifier circuit 23 is converted into digital data by an A/D converter circuit 25 and the CPU 101 acquires temperature information on the print head 1 based on the digital data.

[Control System of Printing Apparatus Main Body]

Figure 4:
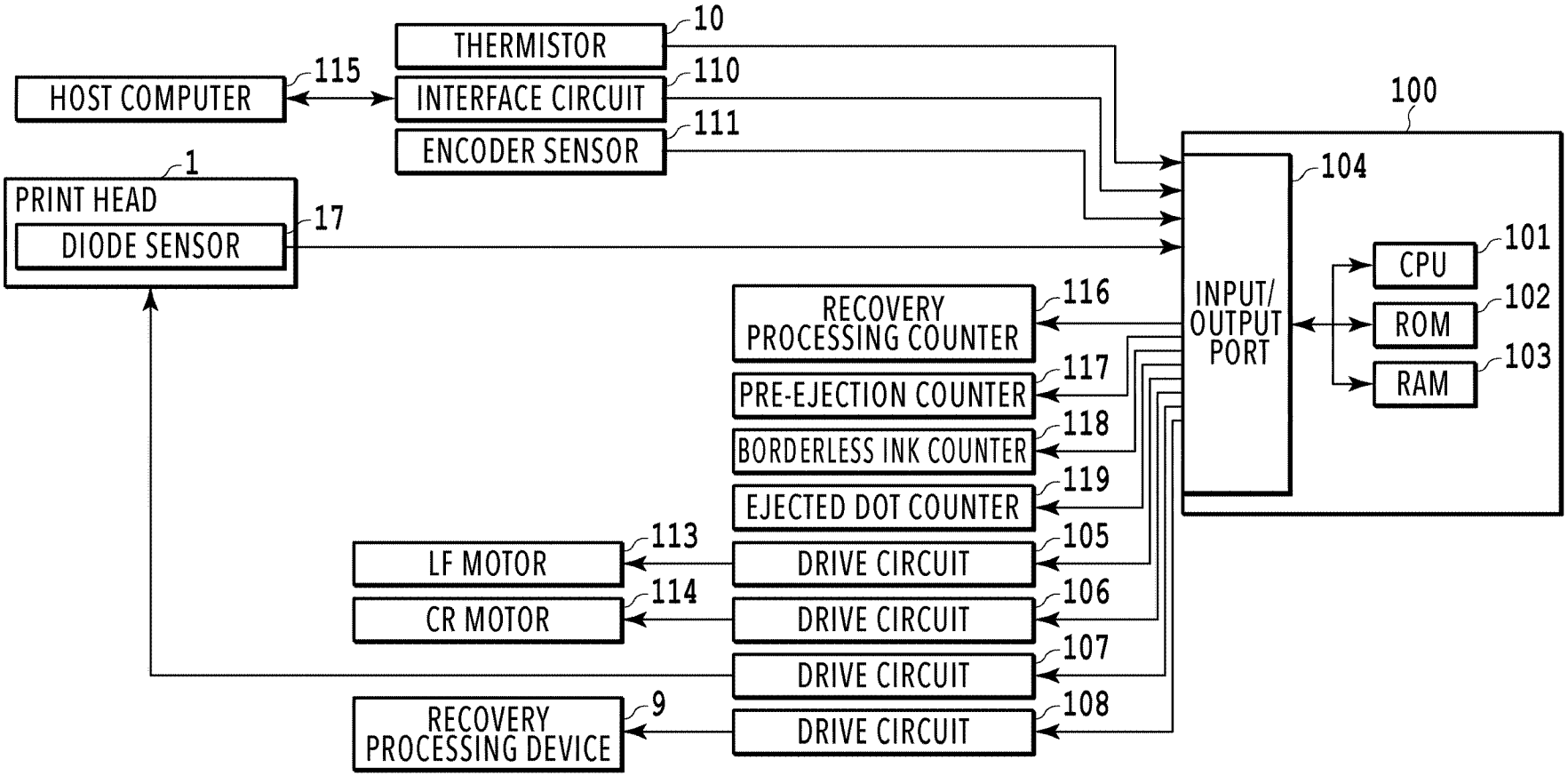
FIG. 4 is a block diagram of a control system in the ink jet printing apparatus in FIG. 1.

FIG. 4 is a block configuration diagram of a control system (control unit) mounted on the main body of the printing apparatus of the present embodiment.

The main control unit 100 includes the CPU 101 that performs processing operation, such as arithmetic operation, control, determination, and setting, and a ROM 102 that stores control programs and the like to be executed by the CPU 101. Further, the main control unit 100 includes a RAM 103 used as a buffer that stores binary print data indicating ejection/non-ejection of ink, a work area of processing by the CPU 101, and so on, and an input/output port 104. It is also possible to use the RAM 103 as a storage unit configured to store the amounts of ink of the main tank before and after the printing operation, the available volume of the sub tank, and so on. To the input/output port 104, drive circuits 105, 106, 107, and 108 that drive a conveyance motor (LF motor) 113 that causes the conveyance roller 6 to drive, a carriage motor (CR motor) 114, the print head 1, the recovery processing device 9 and so on are connected. These drive circuits 105, 106, 107, and 108 are controlled by the main control unit 100. To the input/output port 104, various sensors, such as the diode sensor 17 that detects the temperature of the print head 1, an encoder sensor 111 fixed to the carriage 2, and the thermistor (first detection unit) 10 that detects the ambient temperature (environment temperature) within the printing apparatus, are connected. Further, the main control unit 100 is connected to a host computer 115 via an interface circuit 110.

A recovery processing counter 116 counts the amount of ink in a case where the recovery processing device 9 forcefully ejects ink not participating in printing of an image from the print head 1. A preparatory ejection (hereinafter, described as pre-ejection) counter 117 counts the amounts of ink before printing starts, after printing is completed, and ejected by pre-ejection during printing. A borderless ink counter 118 counts the amount of ink ejected to the outside of the area of the printing medium 5 in a case where borderless printing is performed and an ejected dot counter 119 counts the number of times of ejection of ink during printing.

At the time of printing operation, first, print data received from the host computer 115 via the interface circuit 110 is loaded onto the buffer of the RAM 103. Then, by instructions to perform printing operation being given, the conveyance roller 6 operates, the printing medium 5 is conveyed to a position in opposition to the print head 1, and the carriage 2 is moved in the main scanning direction along the guide rail 3. By the print head 1 ejecting ink from the ejection port accompanying the movement of the carriage 2, an image corresponding to one band is printed on the printing medium 5. After this, the printing medium 5 is conveyed by one band in the sub scanning direction by the conveyance roller 6. By repeating the operation such as this, a predetermined image is printed on the printing medium 5.

The position to which the carriage 2 has moved is detected by the main control unit 100 counting a pulse signal output from the encoder sensor 111 by accompanying the movement of the carriage 2. That is, in an encoder film, not shown schematically, arranged along the main scanning direction, the detection units are formed at regular intervals and the encoder sensor 111 detects the detection unit and outputs a pulse signal in accordance with the movement of the carriage 2. The main control unit 100 detects the position to which the carriage 2 has moved by counting the pulse signal. The movement of the carriage 2 to the home position and the movement to another position are controlled based on signals from the encoder sensor 111.

[Ink Supply System]

Figure 5:
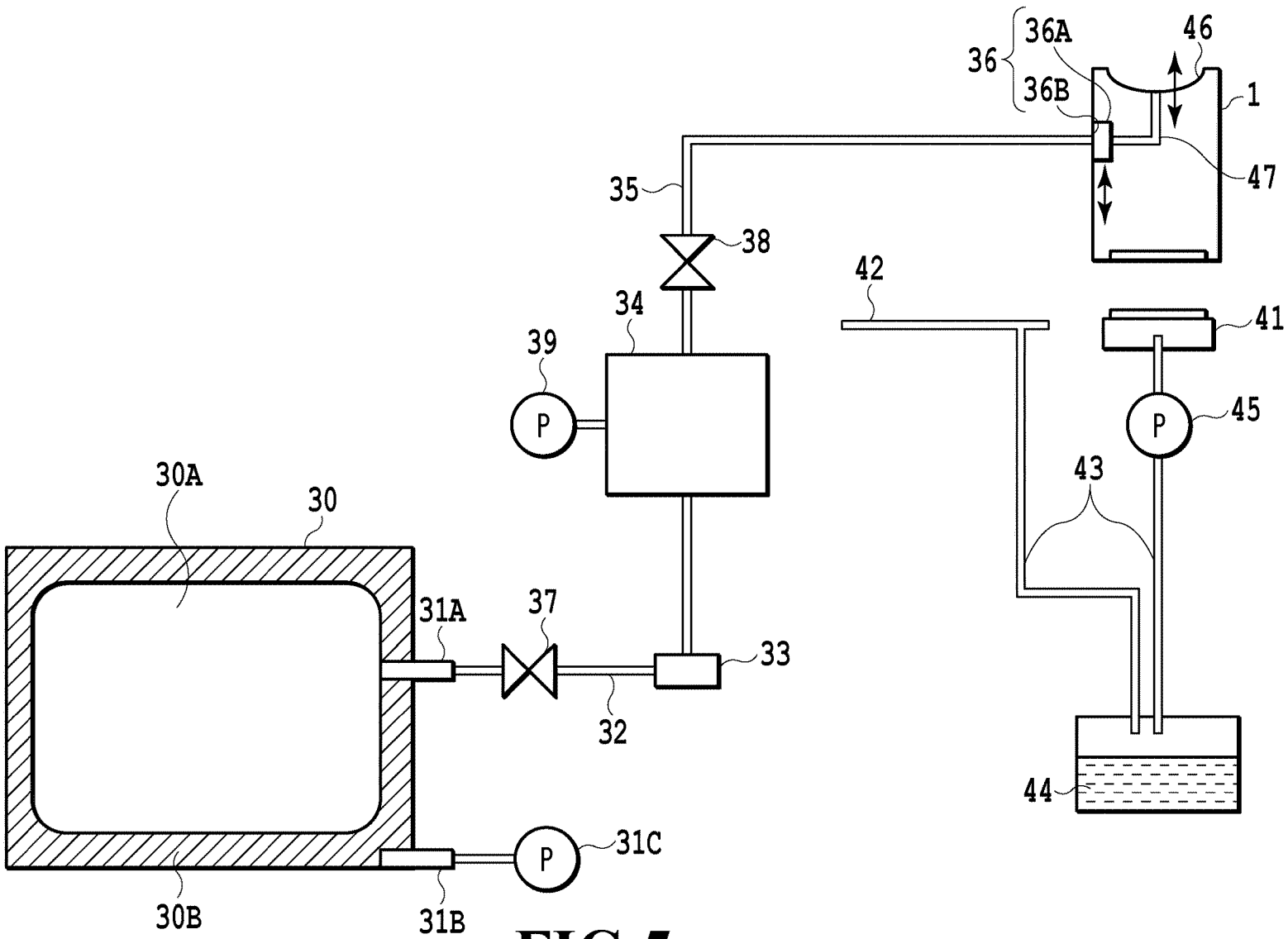
FIG. 5 is an explanatory diagram of a supply/discharge system of ink in the ink jet printing apparatus in FIG. 1.

FIG. 5 is an explanatory diagram of a supply/discharge system of ink in the printing apparatus.

The ink within an ink tank 30 is supplied from an ink supply unit 31A to the print head 1 via a supply pipe 32, a joint 33, a pressure chamber 34, a supply pipe 35, and a supply valve 36. A valve 37 between the ink tank 30 and the pressure chamber 34 and a valve 38 between the pressure chamber 34 and the supply valve 36 are opened and closed as needed. It is possible to store ink in an amount less than or equal to a predetermined amount in the pressure chamber 34. A pump 39 sucks in ink into the pressure chamber 34 from the ink tank 30 by depressurizing the inside of the pressure chamber 34 and further, supplies the ink stored within the pressure chamber 34 to the print head 1 by pressurizing the inside of the pressure chamber 34. The ink tank 30 of the present embodiment includes an ink storage unit 30A at least part of which is formed by a flexible member, and a pressure adjustment unit 30B capable of adjusting pressure, which communicates with a pump 31C through a pressure introduction unit 31B. By controlling the pressure within the pressure adjustment unit 30B by using the pump 31C, it is possible to perform control so that the pressure of the ink is within a predetermined range regardless of a change in the amount of ink within the ink storage unit 30A.

The ink that is ejected from the print head 1 and does not participate in printing (waste ink) is collected in a cap 41 and a pre-ejection port 42 and stored in a waste ink reservoir 44 via a waste ink recovery pipe 43. The cap 41 is arranged at a position shifted to one side in the main scanning direction from the print area on the printing medium and is used to protect and maintain humidity of a formation surface of the ejection port (ejection port surface) in the print head 1 in the state where printing is not performed. Further, the cap 41 is also used for receiving the ink preparatorily ejected before the start of printing and during printing and for a suction recovery operation to suck in ink from the ejection port of the print head 1. The waste ink stored within the cap 41 by pre-ejection is recovered by a suction pump 45 and stored in the waste ink reservoir 44 via the waste ink recovery pipe 43.

At the time of the suction recovery operation, the cap 41 adheres closely to the ejection port surface of the print head 1 and by the suction pump 45, the ink is sucked into the cap 41 from the ejection port of the print head 1, and the ink is stored in the waste ink reservoir 44 via the waste ink recovery pipe 43. The pre-ejection port 42 is arranged at a position shifted to the other side in the main scanning direction from the print area on the printing medium, that is, at a position opposite to the cap 41, or at any position outside the print area on the printing medium. The waste ink stored at the pre-ejection port 42 is stored in the waste ink reservoir 44 by the force of gravity via the waste ink recovery pipe 43.

Part of the wall making up the ink storage unit of the print head 1 is made up of a flexible film 46. The flexible film 46 expands and contracts in accordance with a change in the pressure within the print head 1 accompanying ink consumption and the expansion and contraction are transmitted to a valve body 36A of the supply valve 36 via an arm 47 linked to the flexible film 46. The supply valve 36 opens and closes the connection portion between the ink supply pipe 35 and the print head 1 by the valve body 36A moving in the vertical direction in FIG. 5 in an interlocking manner with the expansion and contraction of the flexible film 46 with respect to a valve seat 36B. Due to this, ink is supplied to the print head 1 in accordance with ink consumption by the print head 1.

[Estimation Method of Temperature]

In the present embodiment, in a case where there is a difference between the temperature of the print head and the environment temperature, the detected temperature of the diode sensor 17 in a case where the temperature of the print head becomes sufficiently close to the temperature of the surrounding fluid is estimated in advance without waiting for the temperature of the print head to become sufficiently close to the environment temperature. The estimation of detected temperature such as this is based on the theory described in the following.

Expression 1 in FIG. 6A is a formula of Newton's low of cooling and it is possible to explain heat exchange between a solid (print head) and a surrounding fluid (air) thereof by expression 1. In expression 1, Q [J] is the amount of heat of the solid, t [sec] is the time, S [$m^2$] is the surface area of the solid, T [K] is the temperature of the solid, Tm [K] is the temperature of the fluid, and $\alpha$ [W/($m^2$K] is the heat transfer rate between the solid and the fluid. This expression 1 means that the larger the temperature difference between the solid and the fluid, and the larger the surface area of the solid, and the larger the heat transfer rate $\alpha$, the larger the change with respect to time in the amount of heat Q of the solid is. In expression 1, the negative sign on the right side means that the thermal energy moves from a high temperature to a low temperature. The heat transfer rate $\alpha$ is not a physical property value and changes depending on the flow rate and the like even for the same kind of fluid. In general, in a case where the fluid is water, the heat transfer rate $\alpha$ is larger than in a case where the fluid is air and the heat transfer rate $\alpha$ is larger for forced convection than natural convection. Because of this, the heat transfer rate $\alpha$ is larger in a case of forced convection of water than in a case of natural convection of air.

Expression 2 in FIG. 6B is a definition formula of a specific heat capacity. From a temperature change T [K] in a case where the amount of heat Q [J] is given to a substance whose mass is m [kg], a specific heat capacity c [J/(Kg·K)] is defined. Expression 3 in FIG. 6C represents the temperature T [K] of the solid by a function of the time t [sec] by eliminating the amount of heat Q [J] from expression 1 by using expression 2. Expression 3 means that the change with respect to time in the temperature of the solid is proportional to the temperature difference between the solid and the fluid and a proportion coefficient $\beta$. The proportion coefficient $\beta$ is defined by expression 4 in FIG. 6D. In a case where the surface area, mass and specific heat capacity of the solid are fixed, the proportion coefficient β is proportional to the heat transfer rate α. Expression 5 in FIG. 6E is obtained by solving the differential equation of expression 3 with a boundary condition that the temperature T of the solid=T0 at the time t=t0. Due to this, the temperature T of the solid at any time t is found.

Figure 7:
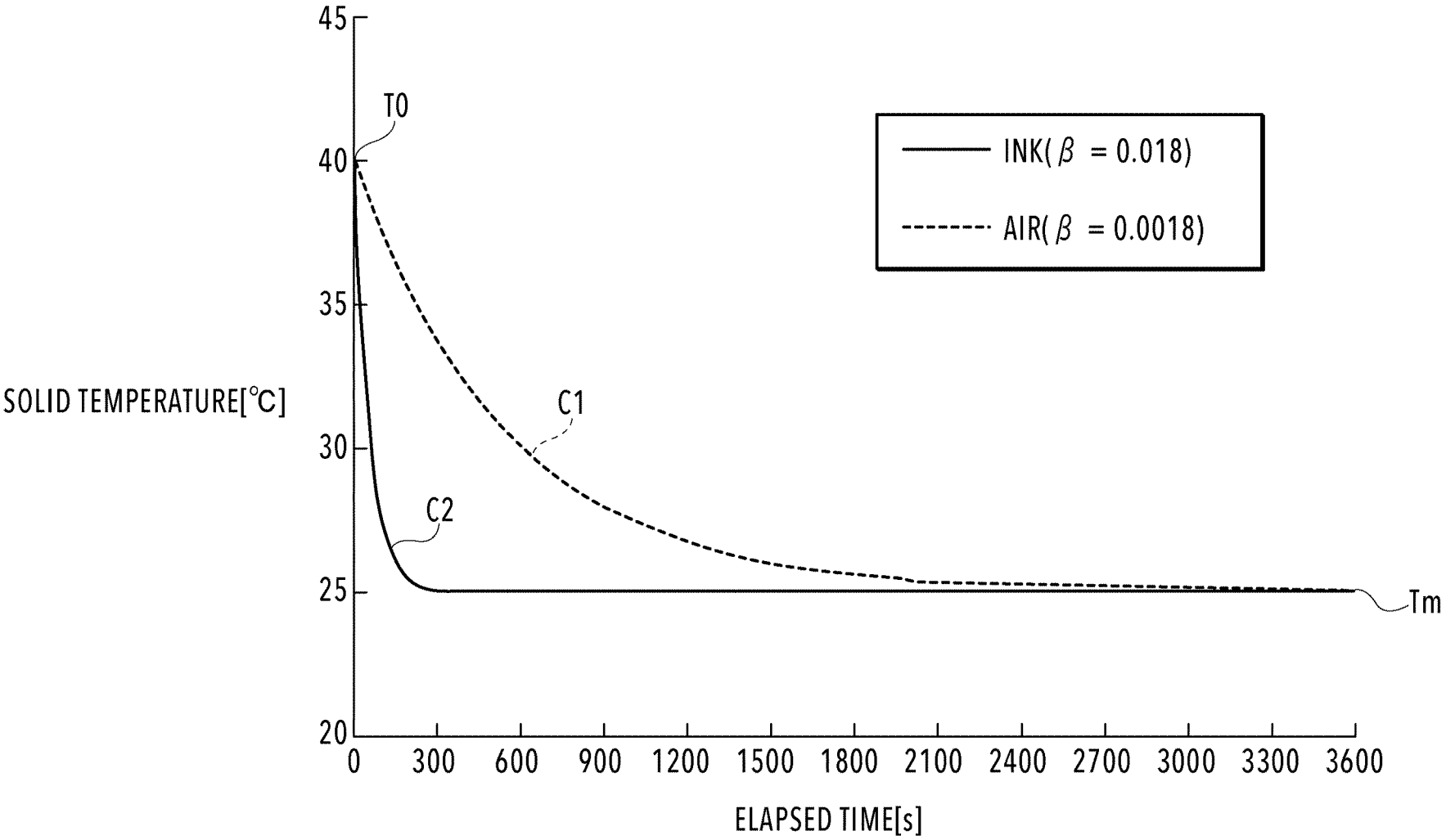
FIG. 7 is an explanatory diagram of a temperature change at the time of exchange of heat between a solid and different fluids.

FIG. 7 is an explanatory diagram of a change with passage of time in the temperature of the solid in a case where it is assumed that the fluid around the solid (print head) is a gas (air) or a liquid (ink). The change is derived by using expression 5. As specific conditions, an initial temperature T0 of the print head 1 at the time t=0 is taken to be 40 [° C.] and the temperature Tm of the fluid around the print head 1 to be 25 [° C.]. Further, the proportion coefficient β of air is taken to be 0.0018 and the proportion coefficient β of ink to be 0.018. In a case where the surface area, mass, and specific heat capacity of the solid are the same and the fluid is the same, the proportion coefficient β is proportional to the heat transfer rate α of air and ink as a result. The time taken for the temperature of the solid whose initial temperature is T0 becomes substantially the same as the temperature Tm of the fluid is about 1 hr. as shown by a curve C1 in FIG. 7 in a case where the fluid is air and on the other hand, in a case where the fluid is ink, the time is about 5 min. as shown by a curve C2 in FIG. 7.

Next, a method of estimating the temperature of the fluid around the solid based on the detected data of the temperatures of the solid at two points in time, whose detection times are shifted from each other, is explained.

Expression 7 in FIG. 6G is obtained by solving the differential equation 3 in FIG. 6C with the following boundary condition. The boundary condition is that the temperature of the solid at time t1 (t=t1) is taken to be a first detected temperature T1 (T=T1) and the temperature of the solid at time t2 (t=t2) is taken to be a second detected temperature T2 (T=T2). For convenience of explanation, the interval of the detection time is taken to be Δt (Δt=t2−t1) and the temperature change of the solid to be ΔT (ΔT=T1−T2) and coefficients A and B are defined as expression 6 in FIG. 6F. These coefficients A and B are functions of only the proportion coefficient β and the time interval Δt and a relationship of A+B=1 holds at all times. Further, in a case where the heat capacity of the fluid is large enough, it is possible to ignore the temperature change of the fluid.

Expression 8 in FIG. 6H is obtained by eliminating the coefficient B and T2 from expression 7 by using ΔT=T1−T2 and the relationship of A+B=1. It is possible to represent the temperature Tm of the fluid by the temperature T2, the coefficient A, and the temperature change ΔT of the solid. The coefficient A is a function of only the proportion coefficient β and the time interval Δt. It is possible to regard the proportion coefficient β as being constant in a case where the kind of solid, the kind of fluid, the flow speed of the fluid, and the pressure of the fluid are the same and it is possible to take the proportion coefficient β to be the coefficient in a case where the time interval Δt is fixed to a constant interval. That is, in a case where the proportion coefficient β is measured in advance by an experiment, it is possible to find the coefficient A. For example, as in expression 9 in FIG. 6I, by increasing the number of detection points of temperature and performing averaging processing, the estimation accuracy of the temperature of the fluid improves. It is possible to calculate the coefficients A and B from the interval ΔT of the detection time, and therefore, the temperature change Δt does not need to be constant.

In the present embodiment, the detected temperature of the diode sensor 17 in a case where the temperature of the print head 1 becomes sufficiently close to the temperature of the surrounding fluid (becomes sufficiently familiar with the temperature of the fluid) is estimated in advance from the detected temperature of the print head (solid) 1 by the diode sensor 17. That is, based on two or more detected temperatures at arbitrary times by the diode sensor 17 before correction, it is possible to estimate in advance the detected temperature of the diode sensor 17 in a case where the temperature of the print head 1 becomes sufficiently close to the temperature of the surrounding fluid. Specifically, by using expression 8 in FIG. 6H, it is possible to estimate in advance the detected temperature of the diode sensor 17 in a case where the temperature of the print head 1 becomes sufficiently close to the temperature of the surrounding fluid from the difference ΔT between the detected temperatures of the print head 1. From the difference between the estimated detected temperature of the diode sensor 17 and the environment temperature, it is possible to find a correction value of the detected temperature of the diode sensor 17. Consequently, in a case where there is a difference between the temperature of the print head 1 and the environment temperature, it is possible to find a correction value of the detected temperature of the diode sensor 17 without the need to wait for the temperature of the print head to become sufficiently close to the environment temperature.

(Correction Processing of Detected Temperature of Diode Sensor)

Figure 8:
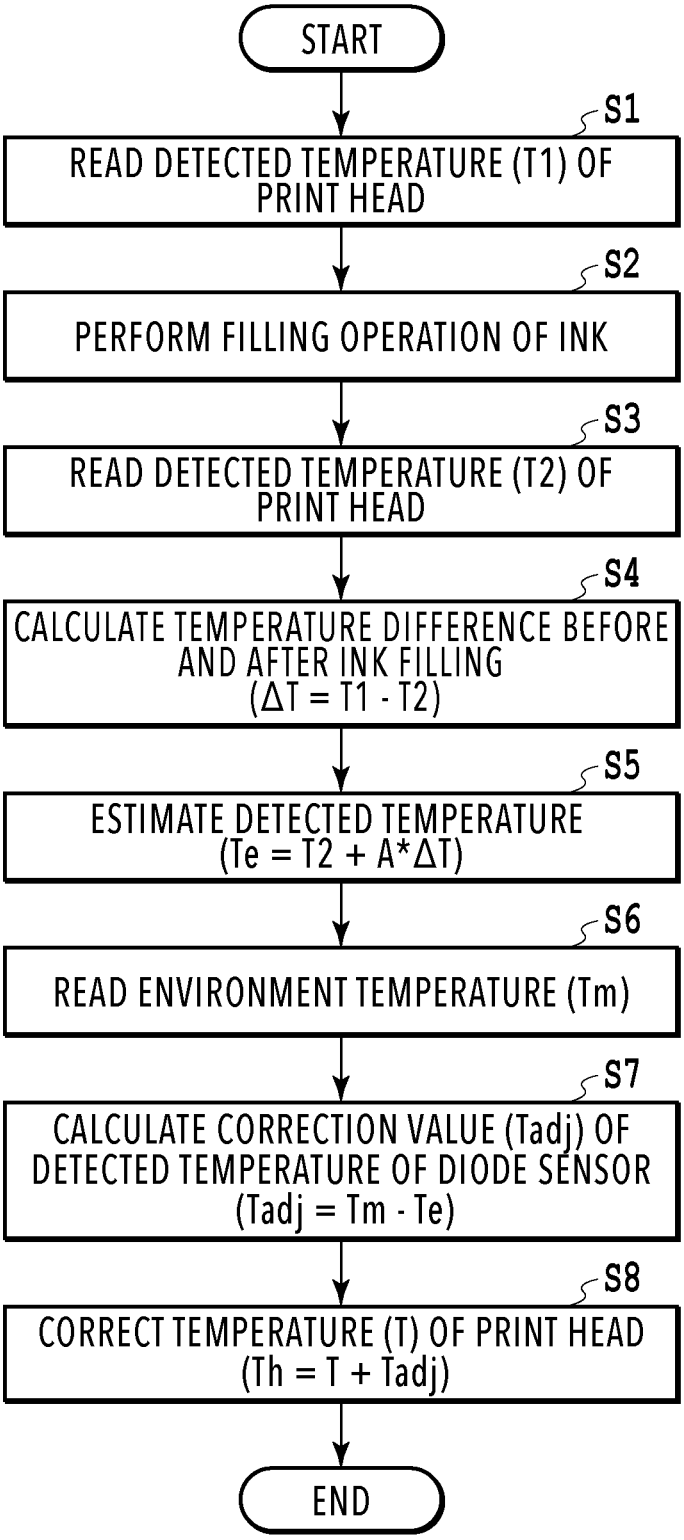
FIG. 8 is a flowchart for explaining correction processing of the detected temperature of a diode sensor.

FIG. 8 is a flowchart for explaining correction processing of a detected temperature of the diode sensor 17.

The detected temperature of the print head 1 by the diode sensor 17 is defined as T, the detected ambient temperature (environment temperature) within the printing apparatus by the thermistor 10 as Tm, the correction value of the detected temperature of the diode sensor 17 as Tadj, and the temperature of the print head 1 after correction as Th. Further, the detected temperatures T of the print head 1 by the diode sensor 17 at different timings t1 and t2 are defined as T1 and T2. As described above, the detected temperatures T at different timings are distinguished from each other by using a suffix and it is assumed that a smaller suffix indicates an earlier timing.

First, the detected temperature T1 of the print head 1 by the diode sensor 17 is read (step S1). The detected temperature T1 is the detected temperature after the print head 1 is attached and before the initial filling of ink for the print head 1 is performed. Next, the print head 1 is initially filled with ink (step S2). In a case where the print head 1 is exchanged with another, the initial filling of ink such as this is indispensable, and therefore, there is no unnecessary increase in time.

The initial filling of ink for the print head 1 is performed by a series of operations as follows.

First, in order to guide ink from the ink tank 30 in FIG. 5 into the supply pipe 32, the inside of the pressure chamber 34 is depressurized by the pump 39. That is, by opening the valve 37 and activating the pump 39 so as to depressurize the inside of the pressure chamber 34, the ink guided from the ink tank 30 is stored in the pressure chamber 34. In a case where the ink is stored within the pressure chamber 34 until a predetermined threshold value is reached, the depressurization inside the pressure chamber 34 is suspended and the valve 37 is closed. Next, the pump 39 is activated so as to pressurize the inside of the pressure chamber 34 and the ink stored in the pressure chamber 34 is pressurized up to a predetermined pressure. By activating the suction pipe 45 after causing the cap 41 to adhere closely to the ejection port surface of the print head 1, the inside of the print head 1 is depressurized via the ejection port. Then, by opening the valve 38, it is possible to supply the ink within the pressure chamber 34 into the print head 1. After a predetermined amount of ink is supplied into the print head 1, the suction pump 45 is suspended and the cap 41 is separated from the print head 1. After the ink is supplied into the print head 1 until the supply valve 36 closes in accordance with the negative pressure within the print head 1, the supply of ink suspends. By the series of operations such as this, the initial filling of ink for the print head 1 is completed.

After the filling operation of ink such as this in FIG. 8 (step S2), the detected temperature T2 of the print head 1 by the diode sensor 17 is read (step S3). The detected temperature T2 is the detected temperature of the print head 1 after the initial filling of ink is performed. After this, the difference ΔT (T1−T2) between the detected temperatures T1 and T2 before and after the ink filling is calculated (step S4). In a case where the temperature of the print head 1 is higher than the environment temperature, the temperature of the print head 1 falls with passage of time, and therefore, the temperature difference ΔT becomes a plus and in a case where the temperature of the print head 1 is lower than the environment temperature, the temperature of the print head 1 rises with passage of time, and therefore, the temperature difference ΔT becomes a minus.

Next, as described previously, by using expression 8 in FIG. 6H, an estimated detected temperature Te of the print head 1 by the diode sensor 17 in a case where the temperature of the print head 1 becomes sufficiently close to the environment temperature is estimated in advance (step S5). The coefficient A in expression 8 is a function of the time interval Δt of temperature detection as described previously, but it is possible to regard the filling time of ink as being constant, and therefore, the coefficient A becomes a constant. That is, provided that the detected temperatures T1 and T2 are known, it is possible to estimate in advance the detected temperature Te of the print head 1 by the diode sensor 17 in a case where the temperature of the print head 1 becomes sufficiently close to the environment temperature.

After this, the environment temperature Tm of the print head 1 is read (step S6). The detection method of the environment temperature Tm is not limited to the method using the thermistor 10 (see FIG. 1) as in the present embodiment and for example, it may also be possible to use a temperature sensor in the ink flow path. In general, the detection accuracy of the thermistor 10 is higher than the detection accuracy of the diode sensor 17, and therefore, it is possible to take the temperature detected by the thermistor 10 to be a reference for finding a correction value of the detected temperature of the diode sensor 17. After this, from the difference between the estimated detected temperature Te and the environment temperature Tm, the correction value Tadj of the detected temperature of the diode sensor 17 is calculated (step S7). Consequently, by adding the correction value Tadj to the detected temperature T of the diode sensor 17 thereafter, it is possible to correct the detected temperature T of the print head 1 (step S8). The detected temperature T after the correction is the detected temperature Th (=T+Tadj) and by correcting the detected temperature T of the diode sensor 17 thereafter to the detected temperature Th, it is possible to use the detected temperature Th after the correction for the drive control of the print head 1.

[Explanation about Influence of Error in Temperature Estimation]

Next, by using FIG. 3, the accuracy of the detected temperature that is estimated as described above (estimated detected temperature) is explained. The main purpose of finding a correction value of a detected temperature of the diode sensor 17 is to correct an offset error unique to a diode sensor.

An offset error of the diode sensor 17 is taken to be Eofs. In the case of the present embodiment, the relationship between a forward voltage Vf of the diode sensor 17 and the detected temperature is 2.1 mV/° C. and the voltage Vf is amplified to twice and five times the voltage Vf by the amplifier circuits 22 and 23, respectively, and therefore, the voltage Vf is amplified to ten times the voltage Vf in total. The relationship between the amplified voltage Vf and the detected temperature is 21 mV/° C. in the stage of being input to the A/D converter circuit 25. The offset error Eofs is ±25 mV for the forward voltage Vf and the equivalent detected temperature is ±11.9° C. from the relationship of 2.1 mV/° C. The offset error Eofs is a systematic error, that is, resulting from the individual variation, and therefore, does not fluctuate.

An A/D conversion error by the A/D converter circuit 25 is taken to be Ead. An input voltage range of the A/D converter circuit 25 is taken to be 3.3 V and the resolution to be 10 bits. The detected temperature range is obtained by dividing the input voltage range by the amplified voltage Vf and 157° C. (=3.3 V÷21 mV/° C.) is obtained. Further, the resolution at the time of quantizing an analog value into a digital value is obtained by dividing the detected temperature range by the resolution and a unit of 0.15° C. (=157° C.÷1024) is obtained. The A/D conversion error Ead is an accidental error, and therefore, fluctuates depending on a search condition and the like.

FIG. 9A and FIG. 9B are explanatory diagrams of specific numerical values in the calculation process of a correction value of a detected temperature of a diode sensor in a case where the fluids are air and ink.

In order to make easy-to-understand the influence of an accidental error for an estimated detected temperature (hereinafter, also referred to simply as "estimated temperature"), in FIG. 9A, the A/D conversion error Ead is taken to be 0 [° C.] and in FIG. 9B, the A/D conversion error Ead to be ±0.15 [° C.]. Further, in each of FIG. 9A and FIG. 9B, it is assumed that that the A/D conversion error Ead changes toward the + side at the time of acquisition of the detected temperature T1 and changes toward the − side at the time of acquisition of the detected temperature T2. Further, the offset error Eofs is taken to be +3.0 [° C.] in each of FIG. 9A and FIG. 9B. Hereinafter, by the presence/absence of an apostrophe ('), a "true value" and a "value including an error" are distinguished from each other. For example, in a case where the temperature T1 of the print head before ink filling is a "true value", the temperature is represented as T1 and in a case of a "value including an error", the temperature is represented as T1'. Further, in a case where the fluid is air, it should be read as the temperature difference of the print head between before and after ink filling results from heat exchange with air, in place of being read as the temperature difference results from heat exchange with ink.

Further, in the following explanation, it is premised that the ink temperature is the same as the environment temperature (ambient temperature on the periphery of the printing apparatus). Of the ink jet printing apparatuses, a printing apparatus that performs printing on a particularly large-sized printing medium consumes a large amount of ink for printing an image. Because of this, in the serial printing apparatus as in FIG. 1, as the supply method of ink for the print head, in place of a so-called on-carriage method, a so-called tube supply method is adopted in many cases. In the on-carriage method, an ink tank is mounted on the carriage 2 and in the tube supply method, ink is supplied to the print head through a tube from a large-capacity ink tank included at a predetermined position within the printing apparatus. In the serial printing apparatus of the present embodiment also, the tube supply method is adopted and as in FIG. 1, from a large-capacity ink tank in the ink supply system 7, ink is supplied to the print head 1 through the supply tube 8. Because of this, it is supposed that the temperature of the ink within the ink tank is sufficiently close to the environment temperature.

In FIG. 9A, in a case where the fluid is ink, the temperature change ΔT is larger than in a case where the fluid is air and the absolute value of the constant A becomes smaller. The reason is that in a case where the fluid is ink, the heat transfer rate α is large, and therefore, the proportion coefficient β becomes large as described previously. However, the estimated temperature calculated in accordance with a calculation expression, that is, an estimated temperature Te' of the print head in a case where the temperature becomes sufficiently close to the environment temperature is 28.0 [° C.] regardless of the kind of fluid (ink, air, and so on) and the correction value of the detected temperature is −3.0 [° C.] regardless of the kind of fluid. The offset error Eofs set in advance is 3.0 [° C.], and therefore, in an ideal state without any accidental error as in FIG. 9A, regardless of the kind of fluid, it is possible to estimate, with the same accuracy, the estimated temperature of the print head in a case where the temperature becomes sufficiently close to the environment temperature.

In a case where there is an accidental error as in FIG. 9B, a temperature difference ΔT' before and after ink filling is different from that in the case of FIG. 9A. The reason is that the temperature difference ΔT' is ΔT'=T1'−T2'=T1−T2+(2*Ead) and the systematic error is eliminated by the difference, but the accidental error Ead still remains. Further, the temperature difference ΔT in a case where the fluid is air is 1.5° C. and the temperature difference ΔT in a case where the fluid is ink is 9.9° C. Because of this, at the time of finding the temperature difference ΔT before and after ink filling, the influence of the accidental error Ead is larger in a case where the fluid is air. Further, the coefficient A in a case where the kind of fluid is air is −8.77 and the coefficient A in a case where the fluid is ink is −0.51 and the absolute value of the coefficient A is larger in a case where the fluid is air.

Further, the estimated temperature of the print head in a case where the temperature becomes sufficiently close to the environment temperature is represented such that the value Te' including an error=T2'+A*ΔT' and the second term on the right side is the product of the coefficient A and the temperature difference ΔT'. Consequently, in a case where the fluid is air, compared to a case where the fluid is ink, the ratio of the accidental error that occupies in the temperature difference ΔT' is large and the coefficient A is also large, and therefore, the influence of the accidental error is amplified. As a result of this, in a case where the fluid is air, the estimated temperature Te' of the print head in a case where the temperature becomes sufficiently close to the environment temperature deviates largely, and the correction value Tadj of the detected temperature becomes −0.4° C. and deviates as largely as 2.6° C. from −3.0° C., which is the theoretical value Tadj. On the other hand, in a case where the fluid is ink, the correction value Tadj of the detected temperature is −2.7° C. and deviates only 0.3° C. from −3.0° C., which is the theoretical value Tadj.

As above, in the present embodiment, from the temperature difference of the print head before and after ink filling, the temperature of the print head in a case where the temperature of the print head becomes sufficiently close to the environment temperature is estimated in advance and the estimation method thereof has the following two points as features. The first feature is that the absolute value of the coefficient A becomes small by performing heat exchange with the print head by using a fluid whose heat transfer rate α is large, such as ink, and the absolute value of ΔT also becomes large, and therefore, it is possible to make slight the influence of the accidental error. That is, the estimation accuracy improves. The second feature is that the filling operation of ink into the print head, which is an indispensable operation, is made use of at the time of attaching a new print head to the printing apparatus. Due to this, the temperature of the print head in a case where the temperature of the print head becomes sufficiently close to the environment temperature is estimated in advance, and therefore, no ink is consumed wastefully and there is no waiting time because a particular time is not required.

Second Embodiment

In the first embodiment described above, the temperature of the print head is estimated by making use of ink filling at the time of exchange of the print head with another. In a second embodiment of the present invention, the temperature of the print head is estimated by making use of ink filling at the time of initial installation of the main body of the printing apparatus (hereinafter, referred to as "initial filling"). In order to avoid duplicated explanation, explanation of the same portions as those of the first embodiment described previously is omitted, and the symbols and the like are the same as those of the first embodiment unless specified particularly.

In the operation of initial filling, the ink supply system 7 in FIG. 1 is filled with ink from a main tank, not shown schematically, and then, the print head 1 is filled with the ink within the main tank via the supply tube 8. In a case of ink filling at the time of exchange of the print head with another in the first embodiment described previously, up to the supply tube 8 is filled with ink in advance. However, at the time of initial filling as in the present embodiment, the supply tube 8 is not filled with ink yet, and therefore, compared to the case of the first embodiment described previously, it takes a time about several times that in the first embodiment to fill the print head 1 with ink. Further, depending on the environment condition (temperature and atmospheric pressure), the time from the cap 41 and the suction pump 45 in FIG. 5 starting to depressurize the inside of the print head 1 until the ink within the main tank arrives at the inside of the print head 1 (hereinafter, called "ink arrival time") changes. For example, in a low-temperature environment, the viscosity of ink increases, and therefore, the viscosity resistance increases and the ink arrival time lengthens. Further, in a depressurized environment, such as highlands, even though the suction amount by the suction pump 45 is the same, the atmospheric pressure is low, and therefore, the ink arrival time lengthens. In addition, depending on a variety of conditions, such as the tolerance of the suction pump 45, the ink arrival time changes. There is a case where the ink arrival time lengthens or a case where the ink arrival time shortens.

Further, in the initial filling of ink, in a case where the amount of ink with which the print head 1 is filled is smaller than a specified amount, there is a possibility that non-ejection of ink in the print head 1, unevenness in density in a printed image and so on occur. Because of this, in general, by taking into consideration that the tolerance of the suction pump 45 or the like is accumulated, setting is performed so as to sufficiently lengthen the filling time in order to obtain a sufficient ink filling amount.

Figure 10A:
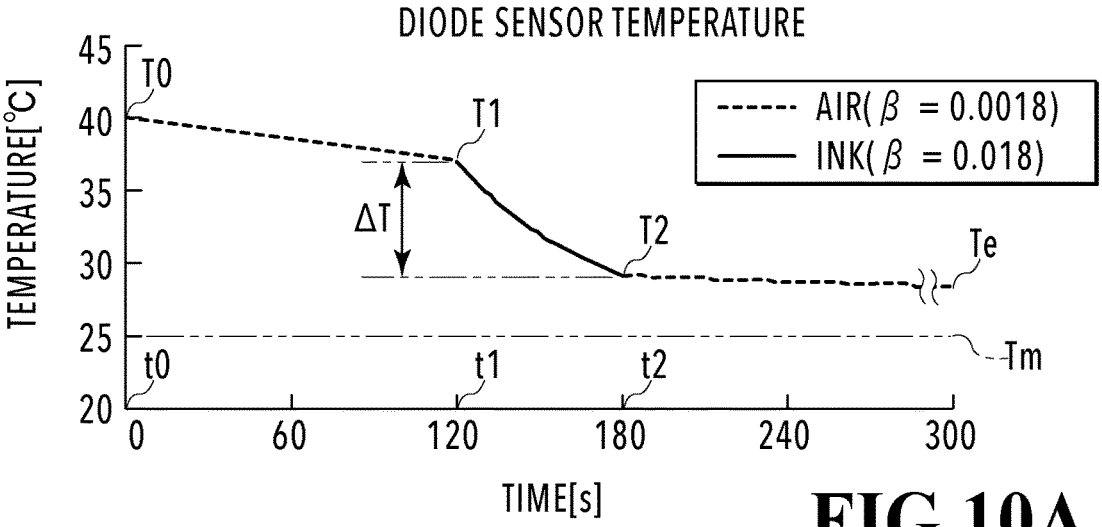
FIG. 10A to FIG. 10C are explanatory diagrams of examples of differential values of the detected temperature of a print head in a second embodiment of the present invention.
Figure 10B:
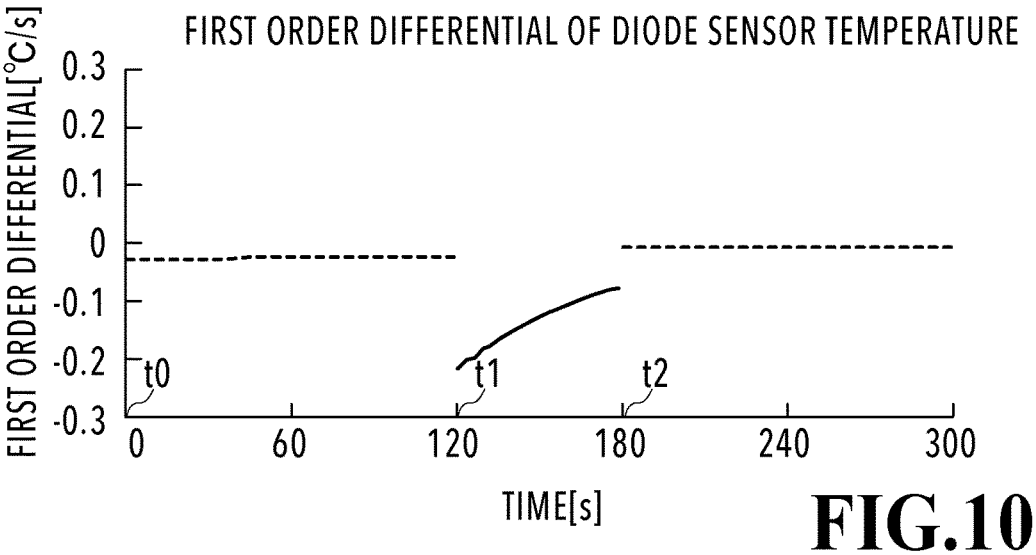
Figure 10C:
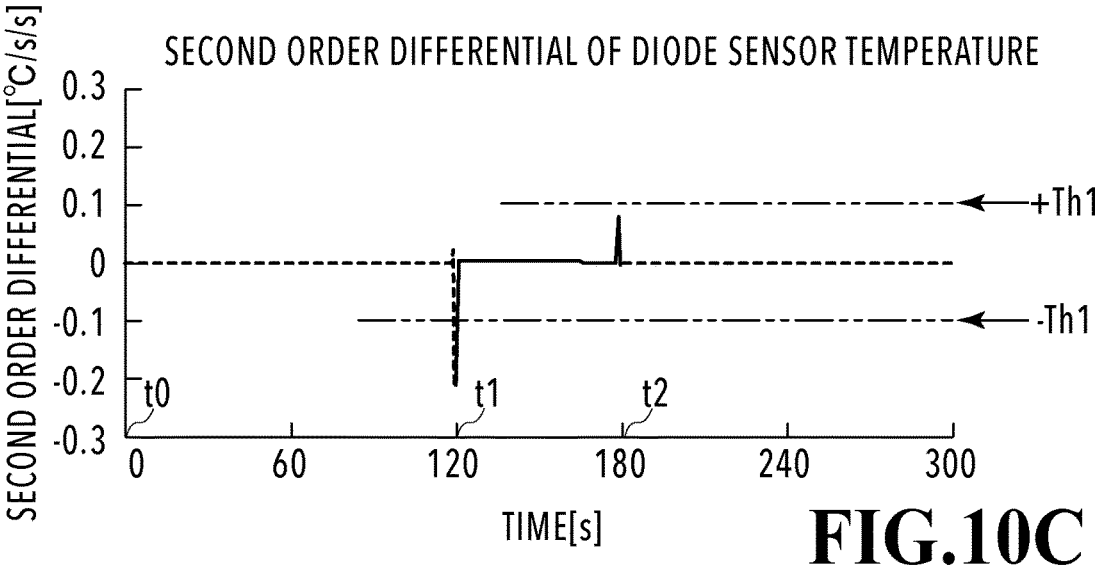

FIG. 10A to FIG. 10C are explanatory diagrams in a case where the deviation between the temperature of the print head 1 and the environment temperature is large at the time of the initial filling of ink.

FIG. 10A is a graph in which detected temperatures of the diode sensor 17 of the print head 1 in the initial filling of ink are plotted. The temperature of the print head at time T0 (t=t0) at which the initial filling of ink is started is taken to be 40° C. (T0=40° C.) and after this, the temperature of the print head 1 at time t1 (t=t1) at which ink arrives at the print head 1 to be 37° C. (T1=37° C.). Further, the temperature of the print head 1 at time t2 (t=t2) at which the initial filling of ink is completed is taken to be 28° C. (T2=28° C.) and the environment temperature to be 25° C. (Tm=25° C.). The reason the temperature change between time t0 and time t1 is small is that the ink has not arrived at the print head 1 yet, and therefore, the proportion coefficient β of the air, which is the fluid within the print head 1, is small. It is possible to grasp time t0 and time t2 because the CPU 101 of the printing apparatus controls them. However, time t1 at which the ink arrives at the print head 1, that is, the point in time at which the ink begins to enter the print head 1 fluctuates depending on the variety of factors as described previously.

As described previously, in order to estimate in advance the temperature of the print head in a case where the temperature of the print head becomes sufficiently close to the environment temperature, the time interval Δt, the temperature change ΔT, and the proportion coefficient β are necessary. It is also possible to define the temperature change as ΔT=T0−T2 by taking the time interval to be Δt=t2−t0. However, depending on the ink arrival time, that is, depending on the timing at which the proportion coefficient β switches to another, the estimation error of the temperature of the print head in a case where the temperature becomes sufficiently close to the environment temperature becomes large. As described above, at the time of the initial filling of ink, it is important to accurately grasp the ink arrival time t1.

FIG. 10B is an explanatory diagram of the estimation method of the ink arrival time t1.

It is assumed that the detected temperature of the diode sensor 17 of the print head 1 is acquired periodically (for example, every second) from the start time of the initial filling of ink. FIG. 10B is a graph in which a value obtained by dividing the difference between the detected temperature of this time and the detected temperature of the previous time by the interval of the detection time is plotted for the detected temperature of the diode sensor 17 at arbitrary detection timing. Mathematically, in a case where the interval of the detection time is made infinitely small, the graph in FIG. 10B corresponds to the gradient (first order differential) of the tangent of the graph in FIG. 10A. Similarly, the graph in FIG. 10C corresponds to the second order differential of the graph in FIG. 10A.

In order to find the ink arrival time t1 specifically, for example, the second order differential value in FIG. 10C (=±0.1 [° C./s$^2$]) is compared with the threshold value±Th1. Then, in a case where the detected temperature of the diode sensor 17 is higher than the environment temperature, the time at which the second order differential value exceeds the threshold value for the first time since the start of the initial filling of ink is determined to be the ink arrival time t1 as in FIG. 10C. Further, in a case where the detected temperature of the diode sensor 17 is lower than the environment temperature, the time at which the second order differential value becomes less than the threshold value for the first time since the start of the initial filling of ink is determined to the ink arrival time t1 as in FIG. 10C. By the method such as this, it is possible to accurately estimate the ink arrival time t1 at the time of the initial filling of ink. After the ink arrival time t1 such as this, that is, after the time in point at which ink begins to enter the print head 1, the diode sensor 17 detects the temperature of the print head 1 at least twice. The estimation method of the detected temperature of the diode sensor 17 in a case where the temperature of the print head 1 becomes sufficiently close to the environment temperature is the same as in the first embodiment described previously, and therefore, explanation is omitted.

Figure 11A:
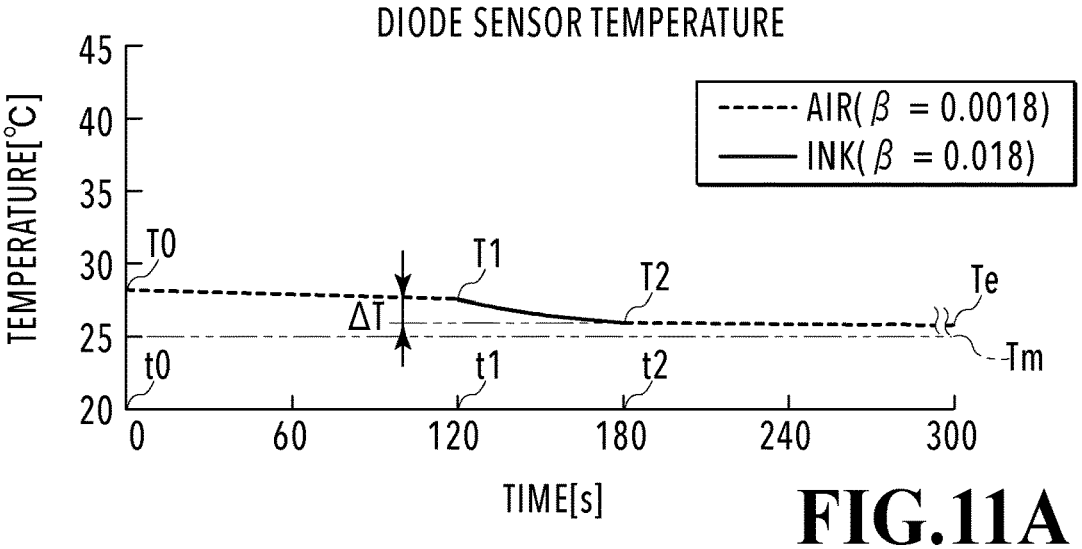
FIG. 11A to FIG. 11C are explanatory diagrams of other examples of differential values of the detected temperature of the print head in the second embodiment of the present invention.
Figure 11B:
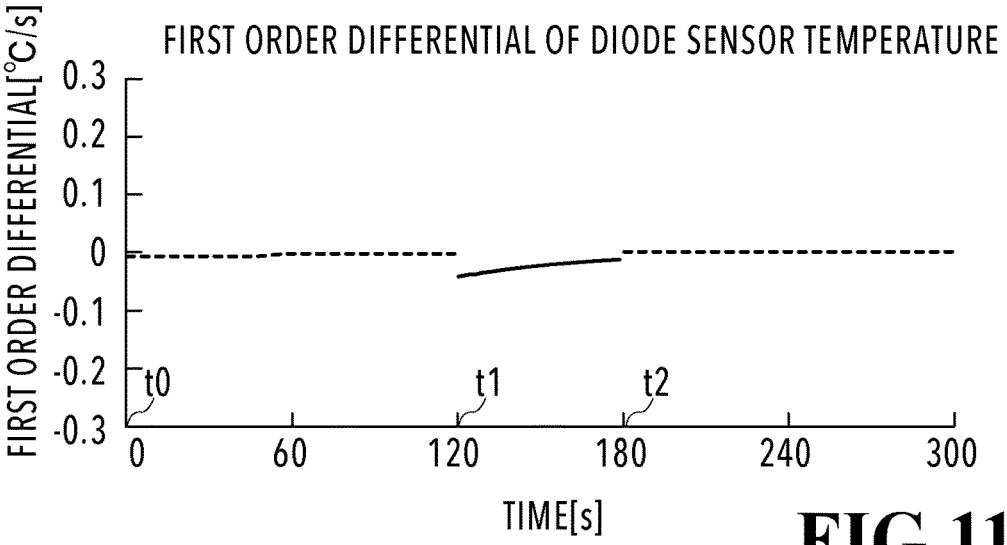
Figure 11C:
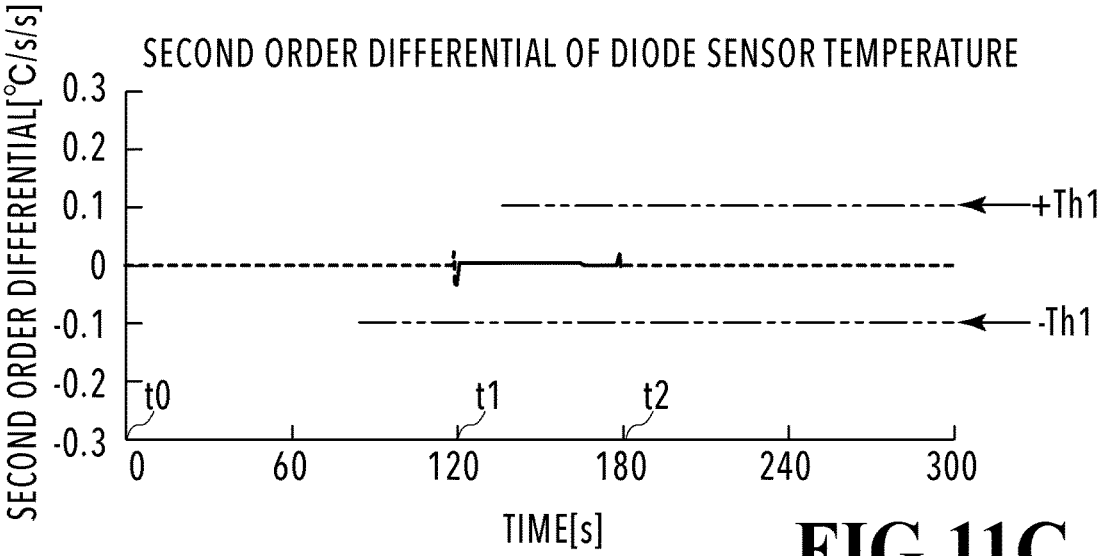

FIG. 11A to FIG. 11C are explanatory diagrams in a case where the deviation between the temperature of the print head 1 and the environment temperature is small at the time of the initial filling of ink.

In an example in FIG. 11A to FIG. 11C, the temperature of the print head 1 at the start time of the initial filling of ink is taken to be 27° C. (T0=27° C.) and the environment temperature to be 25° C. (Tm=25° C.). The other conditions are the same as those in the example in FIG. 10A to FIG. 10C. FIG. 11A is a graph in which detected temperatures of the diode sensor 17 of the print head 1 in the initial filling of ink are plotted. In a case where the temperature difference between the environment temperature and the print head temperature is small as in FIG. 11B and FIG. 11C, the first order differential value and the second order differential value in a case where the fluid within the print head 1 changes from air to water or from water to air become small. That is, it is possible to use those first order differential value and the second order differential value to determine whether or not the temperature of the print head 1 becomes sufficiently close to the environment temperature. Specifically, for example, the second order differential value of a specific value and the threshold value±Th1 are compared and in a case where the second order differential value exceeds the threshold value±Th1, the timing at which the threshold value±Th1 is exceeded is taken to be the ink arrival time t1. Then, from expression (10) below, it is possible to calculate the correction value Tadj of the detected temperature of the diode sensor 17.

$$Tadj = Tm - (T2 + A * \Delta T) \tag{10}$$

On the other hand, in a case where the second order differential value does not exceed the threshold value±Th1, it is determined that the temperature of the print head 1 has already become sufficiently close to the environment temperature and it is only required to calculate the correction value Tadj of the detected temperature of the diode sensor 17 from expression (11) below.

$$Tadj = Tm - T2 \tag{11}$$

As described above, in the present embodiment, by making use of the operation of the initial filling of ink, it is possible to find the correction value of the detected temperature of the diode sensor 17 by accurately estimating the ink arrival time t1 from the detected temperature of the diode sensor 17 of the print head 1. In the present embodiment, explanation is given by using the differential value. In fact, it is not possible to make the detection interval infinitely small, and therefore, a first difference value between detected temperatures at finite detection intervals or a second difference value (difference value between first difference values) is used.

Further, in the present embodiment, the case of the operation of initial filling of ink whose ink arrival time is comparatively long is explained. However, it is also possible to apply the method that makes use of the ink arrival time such as this to a case where the ink filling at the time of print head exchange in the first embodiment described previously is made use of. The reason is that the time from the start of ink filling until the ink arrives at the print head 1 in the ink filling at the time of print head exchange is shorter than that at the time of the initial filling of ink as in the second embodiment, but not zero.

Other Embodiments

In a case where the print head ejects a liquid other than ink, it is also possible to find a correction value of a detected temperature of a diode sensor for detecting the temperature of the print head at the time of filling the print head with the liquid other than ink. As the liquid other than ink, for example, there is a processing liquid for improving water resistance or glossiness of a printed image. Further, in a case where a print head after manufacturing is filled with a liquid for conveyance, which is different from ink, before conveying the print head, it is also possible to find a correction value of a detected temperature of a diode sensor for detecting the temperature of the print head at the time of filling the print head with the liquid for conveyance. Furthermore, the sensor that detects the temperature of the print head is not limited to the diode sensor and it is possible to use various temperature sensors.

The ink jet printing apparatus to which the present invention can be applied is not limited to the serial printing apparatus as in FIG. 1 described previously. For example, it is possible to apply the present invention also to a so-called full line-type printing apparatus that prints an image on a printing medium by continuously conveying the printing medium through the print position of the print head. What is important is that it is possible to apply the present invention to printing apparatuses of various types capable of printing an image on a printing medium accompanied by relative movement of a print head and a printing medium by a moving unit.

Further, it is possible to apply the present invention also to a variety of liquid ejection apparatuses that eject various kinds of liquid from an ejection head and it is possible to find a correction value of s detected temperature of a sensor for detecting the temperature of the ejection head at the time of liquid filling to fill the ejection head with those liquids.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, it is possible, both efficiently and in a brief time, to estimate in advance a detected temperature of a temperature sensor in a case where the temperature of an ejection head becomes sufficiently close to the environment temperature based on a change in the detected temperature of the temperature sensor for the ejection head at the time of liquid filling. As a result of this, it is possible to control the ejection head based on the detected temperature after correction by quickly correcting the detected temperature of the temperature sensor for the ejection head after attaching the ejection head to the liquid ejection apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-238891, filed Dec. 13, 2017, which is hereby incorporated by reference wherein in its entirety.

What is claimed is:

1. A liquid ejection apparatus comprising:

an ejection head capable of ejecting a liquid;

a first detection unit configured to detect a temperature of the ejection head;

a second detection unit configured to detect an environment temperature of the ejection head;

a filling unit configured to fill the ejection head with the liquid;

an estimation unit configured to estimate a temperature in a case where the temperature of the ejection head becomes close to the environment temperature based on a change between two temperatures detected by the first detection unit at different timing, the two temperatures including the detected temperature of the first detecting unit at a time of filling the ejection head with the liquid by the filling unit;

a setting unit configured to set a correction value of the first detection unit based on a difference between the estimated temperature and the environment temperature;

a correction unit configured to correct the first detection unit based on the correction value; and a control unit configured to control the ejection head based on the detected temperature of the first detection unit corrected by the correction unit.

2. The liquid ejection apparatus according to claim 1, wherein the estimation unit estimates the estimated temperature based on first time t1 at the time of filling of the liquid, a first detected temperature T1 detected at the time t1 by the first detection unit, second time t2 at the time of filling of the liquid after the first time t1, a second detected temperature T2 detected at the second time t2 by the first detection unit, and a proportion coefficient A proportional to heat conductivity of the liquid.

3. The liquid ejection apparatus according to claim 2, wherein the estimation unit estimates the estimated temperature as Te by an expression below in a case where a temperature difference between the first detected temperature T1 and the second detected temperature T2 is taken to be ΔT and the proportion coefficient A is taken to be a coefficient on a condition that a time interval Δt between the first time t1 and the second time t2 is fixed to a constant interval, $$Te=T2+A\times\Delta T.$$

4. The liquid ejection apparatus according to claim 1, wherein the estimation unit estimates the estimated temperature based on the temperature change after a point in time at which the liquid begins to enter the ejection head.

5. The liquid ejection apparatus according to claim 4, wherein the estimation unit, in performing the estimation, determines a point in time at which the liquid begins to enter the ejection head based on a first order or second order differential value with respect to time of the detected temperature of the first detection unit at the time of filling of the liquid.

6. The liquid ejection apparatus according to claim 5, wherein the estimation unit, in performing the estimation, determines a time at which the differential value exceeds a predetermined threshold value as a point in time at which the liquid begins to enter the ejection head.

7. The liquid ejection apparatus according to claim 6, wherein the setting unit:

(a) sets the correction value based on a difference between the estimated temperature and the environment temperature in a case where the differential value exceeds the threshold value; and (b) sets the correction value based on a difference between the detected temperature of the first detection unit and the environment temperature at the time of filling of the liquid in a case where the differential value is less than or equal to the threshold value.

8. The liquid ejection apparatus according to claim 1, further comprising:

a moving unit configured to move the print head.

9. A correction method of a first detection unit configured to detect a temperature of an ejection head capable of ejecting a liquid, the correction method comprising:

a detection step of detecting an environment temperature of the ejection head;

a filling step of filling the ejection head with the liquid;

an estimation step of estimating a temperature in a case where the temperature of the ejection head becomes close to the environment temperature based on a change between two temperatures detected by the first detection unit at different timing, the two temperatures including the detected temperature of the first detection unit at the time of filling of the liquid for the ejection head;

a setting step of setting a correction value of the first detection unit based on a difference between the estimated temperature and the environment temperature; and a correction step of correcting the first detection unit based on the correction value.

10. A non-transitory computer-readable storage medium storing a program for causing a computer to perform a correction method of a first detection unit configured to detect a temperature of an ejection head capable of ejecting a liquid, the correction method comprising:

a detection step of detecting an environment temperature of the ejection head;

a filling step of filling the ejection head with the liquid;

an estimation step of estimating a temperature in a case where the temperature of the ejection head becomes close to the environment temperature based on a change between two temperatures detected by the first detection unit at different timing, the two temperatures including the detected temperature of the first detection unit at the time of filling of the liquid for the ejection head;

a setting step of setting a correction value of the first detection unit based on a difference between the estimated temperature and the environment temperature; and a correction step of correcting the first detection unit based on the correction value.

11. The liquid ejection apparatus according to claim 1, wherein a temperature of ink filled in the ejection head is lower than a temperature of the ejection head.

12. The liquid ejection apparatus according to claim 1, wherein a temperature of ink filled in the ejection head is equal to an environment temperature.

* * * * *